US006497263B1

(12) United States Patent
Pitzen

(10) Patent No.: US 6,497,263 B1
(45) Date of Patent: Dec. 24, 2002

(54) DISPENSER WITH CUT-OFF BLADE/SUPPLY ROLL SPACING ASSEMBLY

(75) Inventor: James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 104 days.

(21) Appl. No.: 09/629,410

(22) Filed: Aug. 1, 2000

(51) Int. Cl.[7] ..... B32B 31/18; B32B 31/20; B32B 31/08

(52) U.S. Cl. ..... 156/527; 156/554; 156/577

(58) Field of Search ..... 156/574, 577, 156/579, 527, 523, 554; 225/48, 49, 88; 206/411; 242/571.4

(56) References Cited

U.S. PATENT DOCUMENTS 4,425,182 A * 1/1984 Jones et al. ..... 156/554
4,913,767 A 4/1990 Longworth ..... 156/527
4,990,214 A 2/1991 Heil et al. ..... 156/527
5,113,921 A 5/1992 Pool ..... 156/71
5,445,703 A 8/1995 Steeves et al.
5,472,559 A * 12/1995 Cayford et al. ..... 156/554
5,628,866 A 5/1997 Pool

* cited by examiner

*Primary Examiner*—Richard Crispino
*Assistant Examiner*—George R. Koch, III
(74) *Attorney, Agent, or Firm*—William L. Huebsch

(57) ABSTRACT

A dispenser for dispensing a length of sheet material from a roll of the sheet material. The dispenser includes a first rotatable hub mounted on a dispenser frame that receives the roll of sheet material around its periphery. A first end of an elongate cut-off blade is attached to the frame so that a user of the dispenser can manually tension sheet material being pulled from the roll around a cutting edge on the blade to sequentially transversely sever the sheet material. A locating hub rotatably mounted on one end of a spacing arm is adapted to be received in the roll of sheet material from its end opposite the first hub. An end of the spacing arm opposite the locating hub is mounted on the cut-off blade to space the cutting edge a predetermined distance from the axis of the roll of sheet material at the second end of the roll of sheet material as the sheet material is sequentially transversely cut along the cutting edge on the blade.

18 Claims, 5 Drawing Sheets

DISPENSER WITH CUT-OFF BLADE/SUPPLY ROLL SPACING ASSEMBLY

FIELD OF THE INVENTION

The present invention relates to dispensers for dispensing lengths of a sheet material, which dispensers include a hub rotatably mounted on the frame from only one end, on which hub a roll of sheet material is supported; and which dispensers also include an elongate cut-off blade also attached to the frame from only one end that has a cutting edge spaced from and extending generally parallel to the axis of the hub so that a user of the dispenser can manually tension sheet material being pulled from the roll around the cutting edge to sequentially transversely sever the sheet material.

DESCRIPTION OF THE RELATED ART

U.S. Pat. No. 4,990,214 describes a portable dispenser called a masking machine or device for dispensing lengths of a sheet material, one embodiment of which is sold by Minnesota Mining and Manufacturing Company, St., Paul, Minn. under the trade designation "HandMasker" (t.m.) M3000 Dispenser. Generally, that dispenser includes a polymeric frame on which are rotatably mounted two hubs, one adapted to receive a roll of masking sheet material, and the other adapted to receive a roll of tape. Tape from that roll is guided to the periphery of the roll of masking sheet material where a side portion of the tape is adhered to a portion of the masking sheet material to form a composite masking sheet material having an exposed portion of the coating of pressure sensitive adhesive on the length of tape so that the exposed portion of the coating of adhesive can be adhered along a surface to be masked to hold the composite masking sheet material in a desired position.

A person may pull the composite masking sheet material formed at the periphery of the roll of masking sheet material from the dispenser by either holding the dispenser while pulling on the composite masking sheet material or by moving the dispenser away from the composite sheet material as it is adhered along a surface. A cut-off blade is attached at one end on the frame and extends generally parallel to the axes of the hubs to define a first side of a passageway through which the composite masking sheet material is pulled from the dispenser. A user of the dispenser can manually tension composite masking sheet material being pulled from the dispenser around a row of projecting teeth included in the cut-off blade that will pierce and then transversely sever the tensioned composite masking sheet material starting from the edge of the composite masking sheet adjacent the frame and progressing toward the distal end of the cut-off blade. The cut-off blade is particularly useful for severing composite masking sheet material when the masking sheet material is folded polymeric sheet material of the type described in U.S. Pat. No. 5,113,921. Such piercing by the teeth will advantageously help to maintain the relative positions of the layers of folded polymeric masking sheet material while it is being cut, however, the resultant cut edge on the composite masking sheet material is often not as straight and as close to a right angle to the longitudinal edges of the tape and masking sheet material as may be desired for certain applications of the composite masking sheet material. Applicant has determined that this problem with the resultant cut edge is due to two problems: (1) flexing of the cut-off blade toward the roll as the composite masking sheet material is progressively cut along the cutting edge toward the distal end of the blade; and (2) a slight progressive unwinding of the roll of masking sheet material as the composite masking sheet material is progressively transversely cut on the cut-off blade.

SUMMARY OF THE INVENTION

The present invention provides a modification for a masking machine or device for dispensing lengths of sheet material generally of the type described above that will help the masking machine produce a cut edge on the sheet material that is significantly straighter and closer to a right angle to the longitudinal edges of the sheet material than the cut that is produced by the masking machine or device without the modification, especially when the sheet material dispensed from the device is folded polymeric sheet material.

Generally, the dispenser according to the present invention is for dispensing a length of sheet material from a roll of that sheet material. The dispenser comprises a first hub rotatably mounted on the frame at a first end of the hub that supports the roll of sheet material around its periphery. An elongate cut-off blade has a proximal end attached to the frame and a cutting edge spaced from and extending generally parallel to the axis of the first hub to a distal end of the cut-off blade so that a user of the dispenser can manually tension sheet material being pulled from the dispenser around the cutting edge to sequentially transversely sever the sheet material. The dispenser according to the present invention includes the improvement of a cut-off blade/supply roll spacing assembly that includes (1) a spacing arm, and (2) a locating hub mounted on a second end of the spacing arm. The locating hub is adapted to be received in an opening in the roll of sheet material from a second end of the roll opposite its first end that is adjacent the frame of the dispenser. An opposite first end of the spacing arm is mounted on the cut-off blade adjacent its distal end so that the spacing arm and locating hub space the cutting edge a predetermined distance from the axis of the roll of sheet material at the second end of the roll of sheet material that is a slightly greater distance (e.g., about 0.31 inch or 0.79 cm greater) than the distance between the cutting edge and the axis of the roll of sheet material at the first end of the roll of sheet material as the sheet material is sequentially transversely cut along the cutting edge on the blade. This both (1) restricts the cut-off blade from flexing toward the roll as the sheet material is progressively cut along the cutting edge from the proximal end toward the distal end of the cut-off blade; and (2) accommodates the slight progressive unwinding of the roll of sheet material as the sheet material is progressively transversely cut on the cut-off blade to produce a cut edge on the sheet material that, while not precisely a right angle, is closer to a right angle with respect to the longitudinal edges on the sheet material than is typically produced on the same dispenser without the cut-off blade/supply roll spacing assembly.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
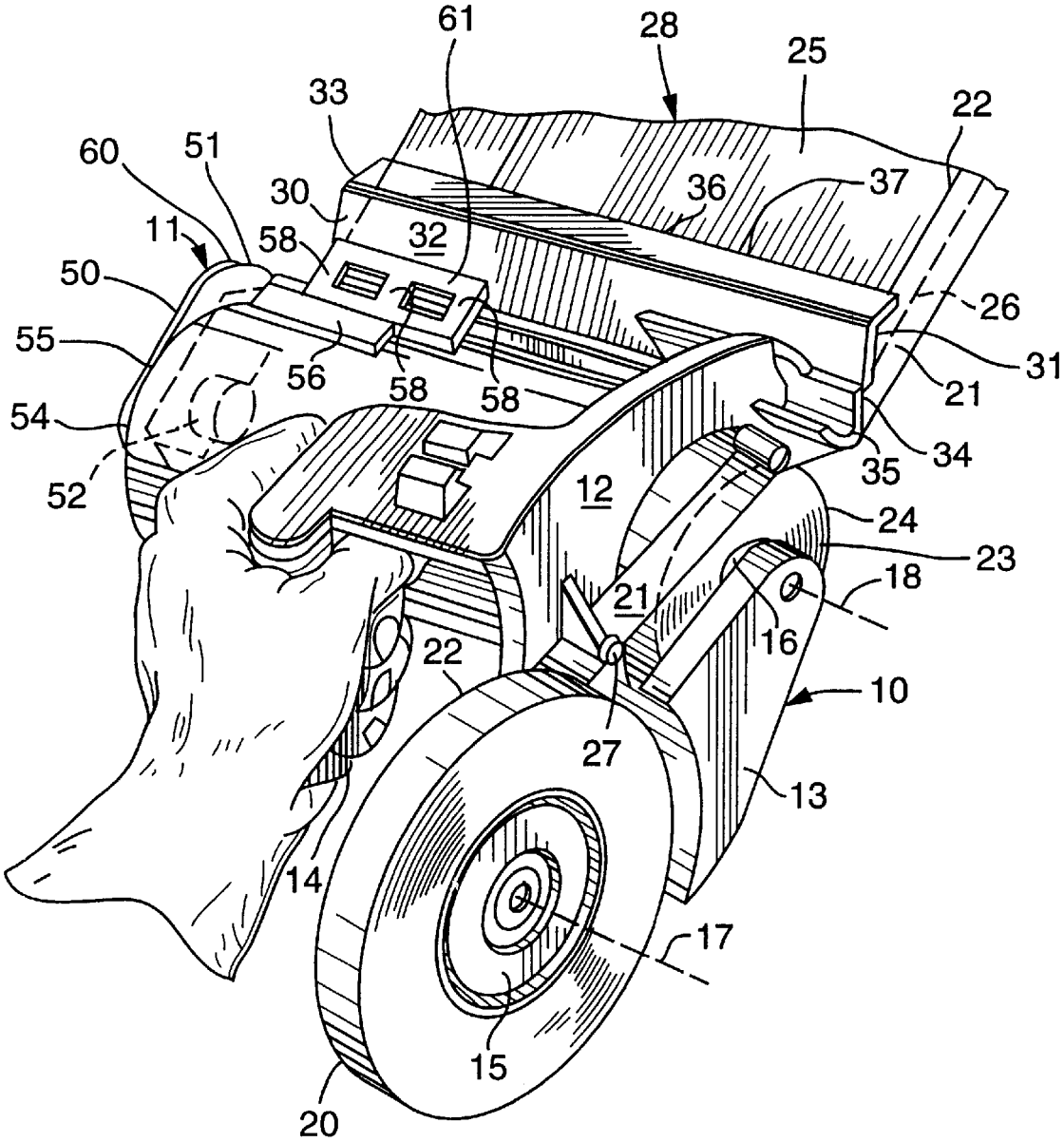
FIG. 1 is a perspective view of a dispenser that includes a first embodiment of a cut-off blade/supply roll spacing assembly according to the present invention.
Figure 2:
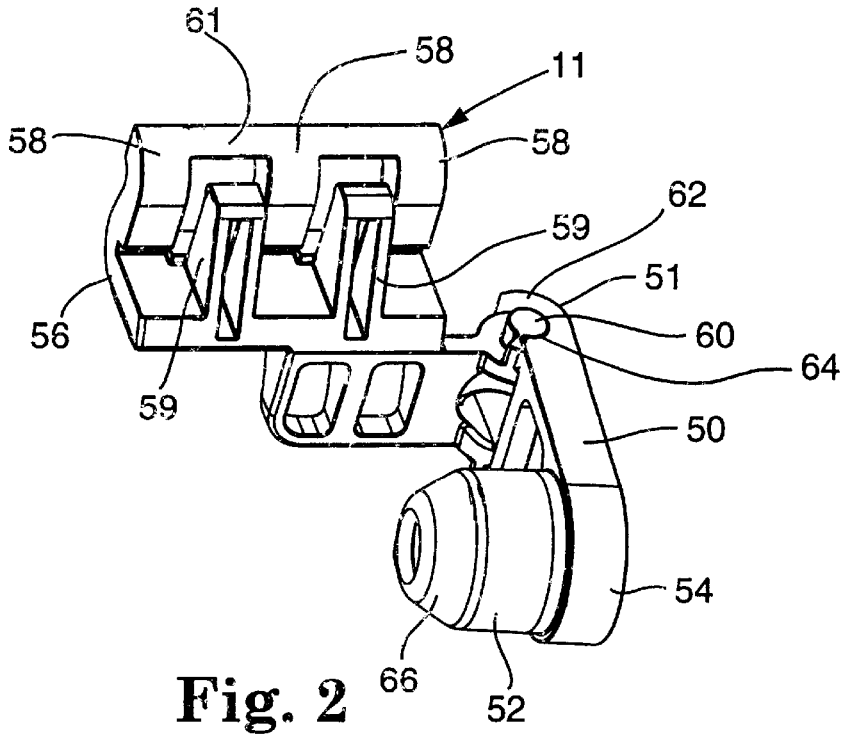
FIG. 2 is an enlarged perspective view of the cut-off blade/supply roll spacing assembly included in the dispenser shown in FIG. 1, which spacing assembly is shown separated from the dispenser and with a spacing arm included in the spacing assembly in a use position.
Figure 3:
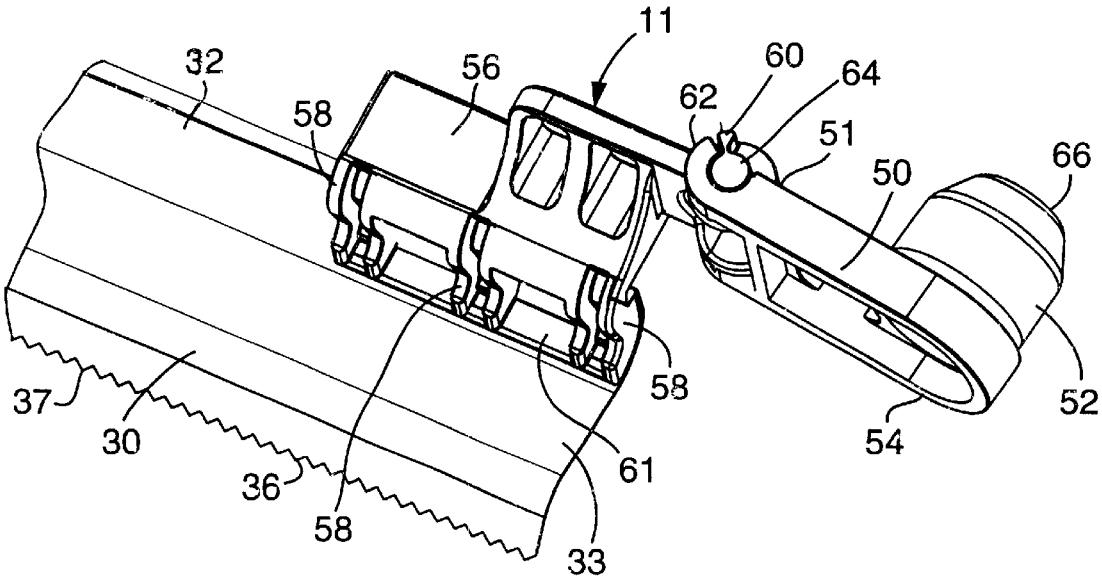
FIG. 3 is a perspective view of the cut-off blade/supply roll spacing assembly shown in FIGS. 1 and 2 mounted on a fragment of the dispenser shown in FIG. 1 with the spacing arm in a loading position.
Figure 4:
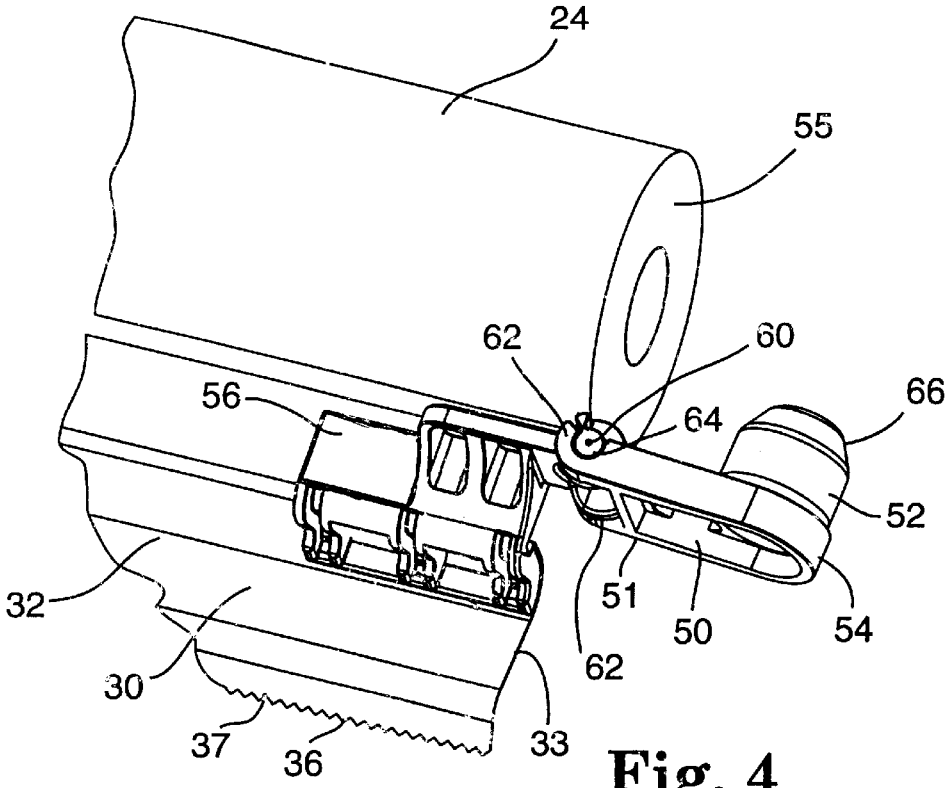
FIG. 4 is a perspective view of the cut-off blade/supply roll spacing assembly shown in FIGS. 1, 2, and 3 mounted on a fragment of the dispenser shown in FIG. 1 with a roll of sheet material mounted on the dispenser and with the spacing arm in the loading position.
Figure 5:
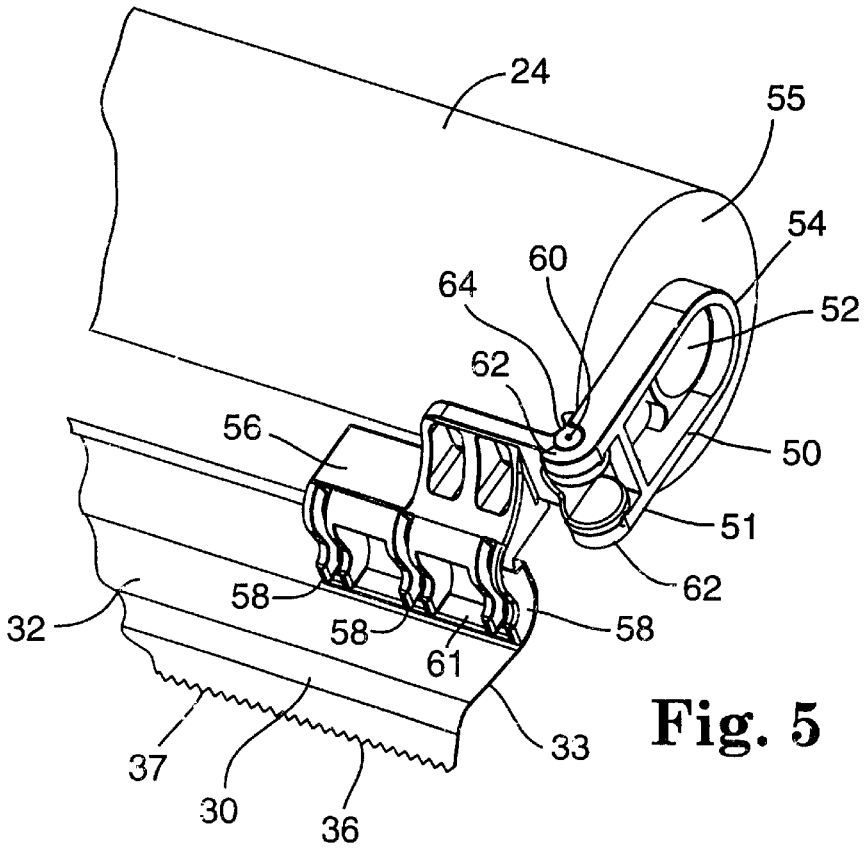
FIGS. 5 and 6 are different perspective views of the cut-off blade/supply roll spacing assembly shown in FIGS. 1, 2, 3, and 4 mounted on a fragment of the dispenser shown in FIG. 1 with the roll of sheet material mounted on the dispenser and with the spacing arm in a use position.
Figure 6:
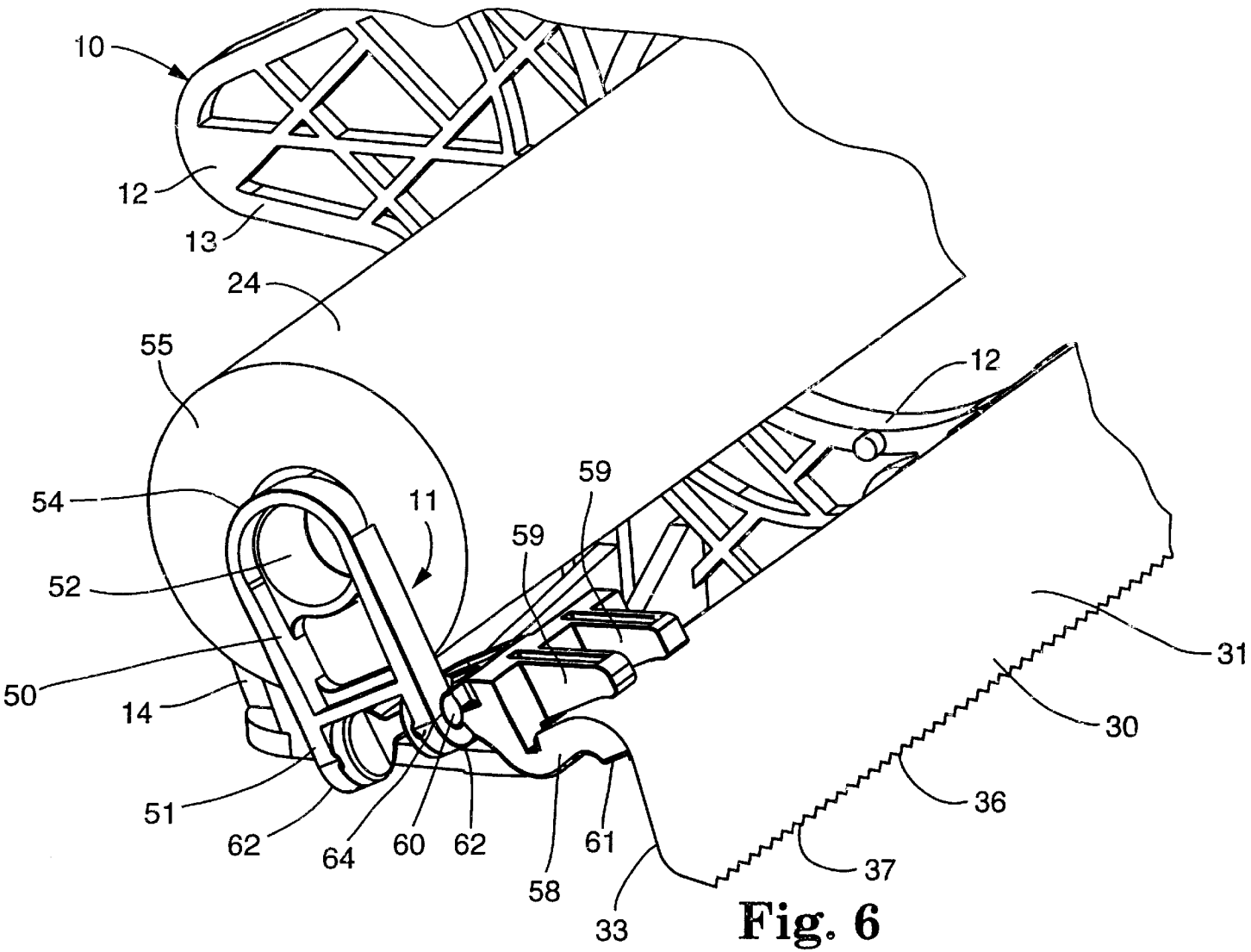

Referring now to FIGS. 1 through 6 of the drawing, there is shown a dispenser 10 including a cut-off blade/supply roll spacing assembly 11 according to the present invention. The dispenser 10 is a modification of a type of dispenser called a masking machine or device that is described in U.S. Pat. No. 4,990,214, one embodiment of which is sold by Minnesota Mining and Manufacturing Company, St., Paul, Minn. under the trade designation "HandMasker" (t.m.) M3000 Dispenser. Generally, the dispenser 10 includes a polymeric frame 12 including a hub support frame member 13 and a handle 14 adopted for manual engagement to manipulate the dispenser 10. First and second hubs 16 and 15 are mounted on the hub support frame member 13 only from first ends of the hubs 16 and 15 for rotation about spaced generally parallel axes 18 and 17. The second hub 15 is adapted to receive a roll 20 of tape 21 around its periphery and to position a first edge 22 of a length of the tape 21 withdrawn from the roll 20 at a first predetermined position axially with respect to the first and second hubs 16 and 15 with the opposite second edge of that withdrawn length of tape 21 projecting past the frame 12. The second hub 16 is adapted to receive a roll 24 of masking sheet material 25 with a first end 23 of that roll 24 adjacent the hub support frame member 13 and to position a first edge 26 of the length of masking sheet material 25 at a second predetermined position axially with respect to the first and second hubs 16 and 15 with the width of the length of tape 21 extending from the first position past the second position and the width of the length of masking sheet material 25 extending from the second position past the first position. A portion of the length of tape 21 along its first edge 22 and a portion of the length of masking sheet material 25 along its first edge 26 are both positioned between those first and second positions. The dispenser 10 includes means including a guide pin 27 that defines a path for the length of tape 21 from the roll 20 of tape 21 to the periphery of the roll 24 of masking sheet material 25 where the portion of tape 21 along the first edge 22 of the length of tape 21 is adhered to the portion of the masking sheet material 25 along the first edge 26 of the length of masking sheet material 25. Such adhesion of the tape 21 to the masking sheet material 25 along the periphery of the roll 24 of masking sheet material 25 forms a composite masking sheet material 28 having opposite edges defined by the second edges of the length of tape 21 and the length of masking sheet material 25 and an exposed portion of the coating of pressure sensitive adhesive along the second edge on the length of tape 21 along one major surface of the composite masking sheet material 28 so that the exposed portion of the coating of adhesive can be adhered along a surface to be masked to hold the composite masking sheet material 28 in a desired position. The masking sheet material 25 in the roll 24 can be of paper or of polymeric materials, can be unfolded or can be longitudinally folded as described in U.S. Pat. No. 4,913,767, or can be a flattened length of tubular material.

The frame 12 defines a passageway on the device 10 through which a person may pull the composite masking sheet material 28 from the periphery of the roll 24 of masking sheet material where it is formed (e.g., such pulling can be accomplished by holding the dispenser 10 in one hand and pulling the composite masking sheet material 28 away from it with the other or by adhering the tape 21 of the composite masking sheet material 28 to a fixed surface such as that of a wall and moving the dispenser 10 along that fixed surface). The dispenser 10 includes a thin metal cut-off blade 30 (e.g., made of 0.018 inch or 0.05 centimeter thick sheet steel) that has parallel opposite first and second major surfaces 31 and 32. The metal cut-off blade 30 is curved along its length to have a generally J-shaped cross section and has an end portion adjacent a proximal end 34 of the blade that is removably attached to a member 35 of the frame 12. The cut-off blade 30 extends generally parallel to the axes 17 and 18 of the hubs 15 and 16 to a distal end 33 of the cut-off blade 30 and defines a first side of the passageway. A user of the dispenser 10 can manually tension the composite masking sheet material 28 being pulled from the roll 24 around a row of similarly shaped projecting teeth 36 included in the cut-off blade 30. The teeth 36 will then pierce and transversely sever the tensioned composite masking sheet material 28 along a cutting edge 37 on the cut-off blade 30, which severing starts adjacent the proximal end 34 of the blade and progresses toward its distal end 36 as that composite masking sheet material 28 is pulled away from the dispenser 10.

The cut-off blade 30 is removably attached to the frame member 35 by means described in U.S. Pat. No. 4,990,214 which briefly comprises the end portion of the J-shaped cut-off blade 30 adjacent its proximal end 34 being hooked around the member 35 of the polymeric part of the frame 12 that is adapted to fit in that end portion and to be retained in that end portion by a pin (not shown) that projects from the member 35 through an opening in the cut-off blade 30. The cut-off blade 30 can be removed from the member 35 by manually pressing on it so that the cut-off blade 30 resiliently bends and flexes over the pin, whereupon the cut-off blade 30 can be unhooked from the member 35.

The teeth 36 on the cut-off blade 30 are similar in shape to the teeth described in U.S. Pat. No. 4,913,767 and can be made by the method described in that patent. Bottom major surfaces of the teeth 36 are triangular parts of the first major surface 31 of the cut-off blade 30, whereas opposite top major surfaces of the primary teeth 36 are triangular parts of the second major surface 32 of the cut-off blade 30. The teeth 36 each have two sides terminating in a point and a base opposite that point. The bases of the teeth 36 are aligned in a first direction longitudinally along the cut-off blade 30 so that the points of the teeth 36 project generally at right angles to that first direction. The sides of adjacent primary teeth 36 intersect at the bases of adjacent teeth 36 to define generally V shaped openings between the adjacent teeth 36. Edge surfaces along the sides of the teeth 36 are disposed at included angles of no greater than about 90 degrees (e.g., at about 30 degrees) with respect to the bottom surfaces of the teeth 36 to define the cutting edge 37 at the intersection of those bottom surfaces and the edge surface along the sides and points of the adjacent teeth 36. The points of the teeth 36 can pierce the composite masking sheet material 28 when that sheet material 28 is pulled across the teeth 36 from their bottom surfaces, and further tension applied on the composite masking sheet material 28 will cause the teeth 36 to further penetrate the composite masking sheet material 28 until the composite masking sheet material 28 is completely severed by the cutting edge 37. The cut-off blade 30 is particularly useful for severing folded polymeric masking sheet material of the type described in U.S. Pat. No. 5,113,921. Such piercing by the teeth 36 will advantageously help to maintain the relative position of the layers of folded polymeric sheet material while it is being cut.

The dispenser 10 according to the present invention includes the improvement of the cut-off blade/supply roll spacing assembly 11. That assembly 11 includes a spacing arm 50 having a first end 51 mounted on the cut-off blade 30 for adjustable sliding movement along its length, and a cylindrical locating hub 52 fixed on a second opposite end 54 of the spacing arm 50, which locating hub 52 has an axis generally normal to the length of the arm 50. The locating hub 52 is adapted to be received with a small clearance (e.g., 0.01 to 0.06 inch or 0.025 to 0.15 cm) in a through opening in the roll 24 of masking sheet material from a second end 55 of the roll 24 opposite its first end 23 so that the axes of the first and locating hubs 16 and 52 are generally co-axial. The spacing arm 50 and locating hub 52 are adapted to space the cutting edge 37 a predetermined distance from the axis 18 of the roll 24 of masking sheet material at the second end 55 of the roll 24 of masking sheet material as the composite masking sheet material 28 is sequentially transversely cut along the cutting edge 37 on the cut-off blade 30 starting from adjacent its proximal end 34 and progressing toward its distal end 33. Preferably, that distance is a slightly greater distance (e.g., about 0.31 inch or 0.79 cm greater) than the distance between the cutting edge 37 and the axes of the first hub 16 and roll 24 of sheet material at the first end 23 of the roll 24 of sheet material. Thus, the cut-off blade/supply roll spacing assembly 11 both (1) restricts the cut-off blade 30 from flexing toward the roll 24 of sheet material as the composite masking sheet material is progressively cut along the cutting edge 37 from adjacent the proximal end 23 toward the distal end 33 of the cut-off blade 30; and (2) accommodates the slight progressive unwinding of the roll 24 of masking sheet material that occurs as the composite masking sheet material 28 is progressively transversely cut on the cut-off blade 30 to produce a cut edge on the composite masking sheet material 28 that, while not precisely a right angle, is closer to a right angle with respect to the longitudinal edges on the composite masking sheet material 28 than is typically produced on the same dispenser 10 without the cut-off blade/supply roll spacing assembly 11.

The first end 51 of the spacing arm 50 is mounted on the cut-off blade 30 for adjustable sliding movement along its length by a slide block portion 56 of the cut-off blade/supply roll spacing assembly 11. That slide block portion 56 has two sets of finger like parts 58 and 59 defining a slot therebetween adapted to conform to the shape of the cut-off blade 30 and having opposite surfaces spaced to provide slight frictional engagement with the cut-off blade 30 so that the slide block portion 56 can be moved to and will tend to stay at different positions longitudinally along the cut-off blade 30 to accommodate rolls 24 of masking sheet material of different lengths. While the first end 51 of the spacing arm 50 could be fixed on the slide block portion 56, optionally, as illustrated, it can be mounted on the slide block portion 56 for pivotal movement around an axis 60 at the first end 51 of the spacing arm 50 between a use position (see FIGS. 1, 2, 5, and 6) at which (with the slide block portion 56 on the cut-off blade 30) the axis of the locating hub 52 is coaxial with the axis 18 of the first hub 16, and a loading position (see FIGS. 3, and 4) to which the spacing arm 50 is pivoted around the axis 60, at which loading position the spacing arm 50 extends generally parallel to the length of the cut-off blade 30 with the locating hub 52 spaced from the axis 18 of the first hub 16 so that a roll 24 of masking sheet material can be placed around the first hub 16 or a core from such a roll 24 can be removed from around the first hub 16.

The cut-off blade/supply roll spacing assembly 11 illustrated is a two piece molding of a polymeric material (e.g., 10% glass filled nylon). Molding of the piece including the slide block portion 56 is facilitated in that there are spaces between the finger like parts 58 that are slightly larger than the opposite finger like parts 59, thereby allowing that piece to be molded using a simple molding tool. A distal portion 61 of the slide block portion joins the ends of the three finger like parts 58, and helps to make frictional engagement with the surface 32 of the cut-off blade 30. Two spaced hook like hinge members 62 at the second end 51 of the spacing arm 50 are sufficiently flexible to firmly engage and yet be removed from around oppositely projecting trunions 64 molded on the slide block portion 56 that define the axis 60 about which the spacing arm 50 pivots. A generally conical tapered end portion 66 is formed on the distal end of the locating hub 52 to help guide it into the opening in the roll 24 of masking sheet material.

Figure 7:
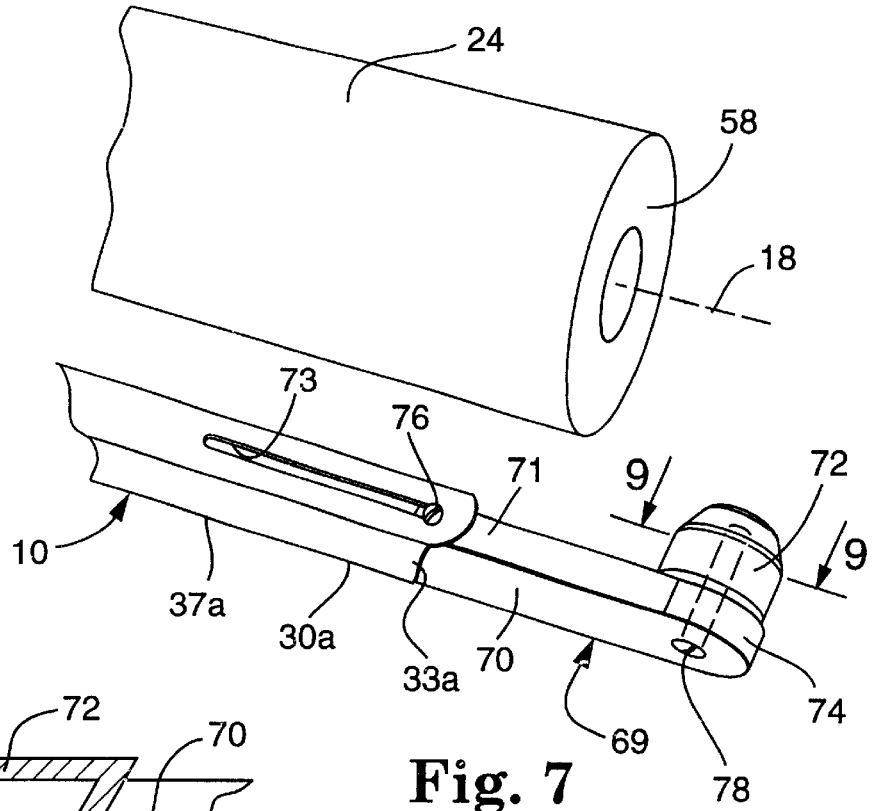
FIG. 7 is a fragmentary perspective view of a dispenser similar to the dispenser of FIG. 1 that includes a second embodiment of a cut-off blade/supply roll spacing assembly according to the present invention shown with a roll of sheet material mounted on the dispenser and with a spacing arm of the cut-off blade/supply roll spacing assembly in a loading position.
Figure 9:
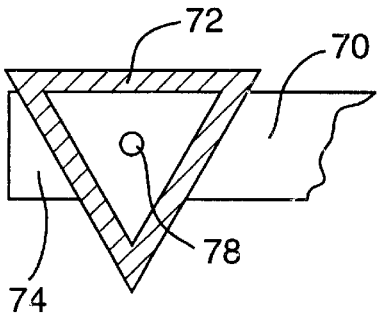
FIG. 9 is a fragmentary enlarged sectional view taken approximately along line 9—9 of FIG. 7.
Figure 8:
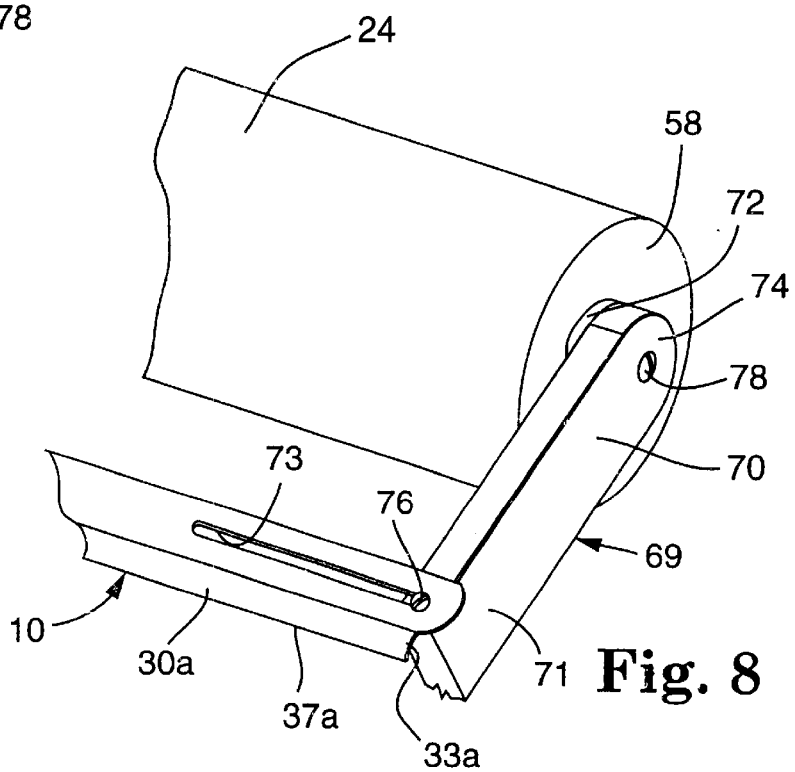
FIG. 8 is a fragmentary perspective view of the dispenser of FIG. 7 shown with a roll of sheet material mounted on the dispenser and with the spacing arm of the cut-off blade/supply roll spacing assembly in a use position.

FIGS. 7 through 9 illustrate an alternate embodiment of the improvement of a cut-off blade/supply roll spacing assembly 69 for the dispenser 10 according to the present invention. That assembly 69 includes a spacing arm 70 having a first end 71 mounted on a cut-off blade 30*a* (which cut-off blade 30*a* has the same structure as the cut-off blade 30 except for the addition of a longitudinally extending slot 73) for adjustable sliding movement in the slot 73 along its length, and a locating hub 72 rotatably mounted on a second opposite end 74 of the spacing arm 70, which locating hub 72 has an axis generally normal to the length of the arm 70. The locating hub 72 is adapted to be closely received in the opening in the roll 24 of masking sheet material from the second end 58 of the roll 24 opposite its first end 23 so that the axes of the first and locating hubs 18 and 72 are generally co-axial. The spacing arm 70 and locating hub 72 are adapted to space the cutting edge 37*a* a predetermined distance from the axis 18 of the roll 24 of masking sheet material at the second end 58 of the roll 24 of masking sheet material as the composite masking sheet material 28 is sequentially transversely cut along the cutting edge 37*a* on the cut-off blade 30*a* starting from adjacent its proximal end and progressing toward its distal end 33*a*. Preferably, that distance is a slightly greater distance (e.g., about 0.31 inch or 0.79 cm greater) than the distance between the cutting edge 37*a* and the axes of the first hub 18 and roll 24 of sheet material at the first end 23 of the roll 24 of sheet material. Thus, the cut-off blade/supply roll spacing assembly 69 both (1) restricts the cut-off blade 30*a* from flexing toward the roll 24 of sheet material as the composite masking sheet material is progressively cut along the cutting edge 37*a* from adjacent the proximal end toward the distal end 33*a* of the cut-off blade 30*a*; and (2) accommodates the slight progressive unwinding of the roll 24 of masking sheet material that occurs as the composite masking sheet material 28 is progressively transversely cut on the cut-off blade 30*a* to produce a cut edge on the composite masking sheet material 28 that, while not precisely a right angle, is closer to a right angle with respect to the longitudinal edges on the composite masking sheet material 28 than is typically produced on the same dispenser 10 without the cut-off blade/supply roll spacing assembly 69.

The first end 71 of the spacing arm 70 is mounted on the cut-off blade 30*a* for adjustable sliding movement in the slot 73 along the length of the blade 30*a* by a flat headed screw 76 which extends through the slot 73. The screw 76 can be slid in the slot 73 to different positions longitudinally along the cut-off blade 30*a* to accommodate rolls 24 of masking sheet material of different lengths, and the screw 76 can rotate in the slot 73 to afford pivotal movement of the arm 70 around the axis of the screw 76 at the first end 71 of the spacing arm 70 between a use position (see FIG. 8) at which the axis of the locating hub 72 is coaxial with the axis 18 of the first hub 18, and a loading position (see FIG. 7) at which the spacing arm 70 extends generally parallel to the length of the cut-off blade 30*a* with the locating hub 72 spaced from the axis 18 of the first hub 18 so that a roll 24 of masking sheet material can be placed around the first hub 18 or a core from such a roll 24 can be removed from around the first hub 18.

The cut-off blade/supply roll spacing assembly 69 includes the spacing arm 70 and the locating hub 72 which both can be molded of a polymeric material (e.g., 10% glass filled nylon). The hub 72 is rotatably mounted on the second end 74 of the arm 70 by a bolt 78. The locating hub 72 has a triangular cross section (see FIG. 9) that is sized so that the three axially extending ridges on the hub 72 will fictionally engage the core of the roll 24 of masking sheet material to hold the hub 72 within that core.

The present invention has now been described with reference to two embodiments and possible modifications thereof. It will be apparent to those skilled in the art that many changes can be made in the embodiments described without departing from the scope of the present invention. For example, as noted above, the first end 51 of the spacing arm 50 could be fixed on the slide block portion 56 which would require that the slide block portion 56 be moved along the cut off blade 30 to engage or disengage the locating hub 52 from the roll 24 of masking sheet material. Thus, the scope of the present invention should not be limited to the structures described in this application, but only by the structures described by the language of the claims and the equivalents thereof

What is claimed is:

1. A portable dispenser for dispensing lengths of sheet material from a roll of the sheet material having an axis, axially spaced first and second ends, and an inner surface defining a openings through both of said ends, said dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub;

an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

a cut-off blade/supply roll spacing assembly comprising:

a spacing arm having first and second ends, a locating hub having an axis, said locating hub being mounted on said second end of said spacing arm and having a periphery around said axis adapted to be received in the opening through the second end of the roll of sheet material; and mounting means for mounting said first end of said spacing arm on said cut-off blade so that with the roll of sleet material positioned around said first and locating hubs said spacing arm extends directly between said mounting means and said locating hub to space the cutting edge a predetermined distance from the axis of the roll of sheet material at the second end of the roll of sheet material as the sheet material is sequentially transversely cut along the cutting edge on the blade, said mounting means mounting said first end of said spacing arm for pivotal movement of said spacing arm around an axis at the first end of the spacing arm between a use position at which the axis of the locating hub is coaxial with the axis of the first hub, and a loading position at which the spacing arm extends generally parallel to the length of the cut-off blade with the locating hub spaced from the axis of the first hub so that a roll of masking sheet material can be placed around the first hub.

2. A dispenser adapted to dispense lengths of sheet material from rolls of the sheet material each having an axis, axially spaced first and second ends, and an inner surface defining an opening through both of said ends, the rolls having axial lengths between their first and second ends in a predetermined range of lengths, said dispenser comprising:

a frame;

a first hub having an axis and first and second axially spaced ends, said hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub;

an elongate nut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

a cut-off blade/supply roll spacing assembly comprising:

a spacing arm having first and second ends;

a locating hub having an axis, said locating hub being mounted on said second end of said spacing arm and having a periphery around said axis adapted to be received in the opening through the second end of the roll or sheet material; and means for mounting said first end of said spacing arm on said cut-off blade so that with the roll of sheet material positioned around said first and locating hubs said spacing arm and locating hub space the cutting edge a predetermined distance from the axis of the roll of sheet material at the second end of the roll of sheet material as the sheet material is sequentially transversely cut along the cutting edge on the blade, said first end of said spacing arm being mounted on said cut-off blade to afford positioning said spacing arm at different locations longitudinally along said cut-off blade.

3. A dispenser according to claim 2, wherein said means for mounting said first end of said spacing arm on said cut-off blade affords pivotal movement of said spacing arm around an axis at the first end of the spacing arm between a use position at which the aids of the locating hub is coaxial with the axis of the first hub, and a loading position at which the spacing arm extends generally parallel to the length of the cut-off blade with the locating hub spaced from the axis of the first hub so that a roll of masking sheet material can be placed around the first hub.

4. A dispenser according to claim 3 wherein said means for mounting comprises a slide bock portion adapted to slide longitudinally along said blade, and said first end of said spacing arm is mounted on said slide block portion to afford pivotal movement of said spacing arm around the axis at the first end of the spacing arm between said use and loading positions.

5. A dispenser according to claim 4 wherein said slide block portion frictionally engages said blade, and said locating hub is fixed on said second end of said spacing arm with said periphery of said locating arm being adapted to received with a small clearance in the opening in the roll of sheet material.

6. A dispenser according to claim 3 wherein said means for mounting comprises said blade having a longitudinally extending slot, and a member at said first end of said spacing arm extending through said slot to afford said sliding of the first end of said spacing arm longitudinally along said blade and said pivotal movement of said first end of the spacing arm between said use and loading positions.

7. A dispenser according to claim 6 wherein said locating hub is rotatably mounted on said second end of said spacing arm and said periphery of said locating hub is adapted to frictionally engage the roll of sheet material.

8. A dispenser for dispensing lengths of sheet material from a roll of tile sheet material having an axis, axially spaced first and second ends, and an inner surface defining a openings through both of said ends, said dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub;

an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

a cut-off blade/supply roll spacing assembly comprising:

a spacing arm having first and second ends;

a locating hub having an axis, said locating hub being mounted on said second end of said spacing arm and having a periphery around said axis adapted to be received in the opening through the second end of the roll of sheet material; and means for mounting said first end of said spacing arm on said cut-off blade so that with the roll of sheet material positioned around said first and locating hubs said spacing arm and locating hub space the cutting edge a predetermined distance from the axis of the roll of sheet material at the second end of the roll of sheet material as the sheet material is sequentially transversely cut along the cutting edge on the blade, said predetermined distance that the cutting edge is spaced from the axis of the roll of sheet material at the second end of the roll of sheet material being slightly greater than the distance between the cutting edge and the axis of the roll of sheet material at the first end of the roll of sheet material.

9. A dispenser for dispensing lengths of sheet material from a roll of the sheet material having an axis, axially spaced first and second ends, and an inner surface defining a openings through both of said ends, said dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub;

an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

a cut-off blade/supply roll spacing assembly comprising:

a spacing arm having first and second ends, a locating hub having an axis, said locating hub being mounted on said second end of said spacing arm and having a periphery around said axis adapted to be received in the opening through the second end of the roll of sheet material; and means for mounting said first end of said spacing arm on said cut-off blade so that with the roll of sheet material positioned around said first and locating hubs said spacing arm and locating hub space the cutting edge a predetermined distance from the axis of the roll of sheet material at the second end of the roll of sheet material as the sheet material is sequentially transversely cut along the cutting edge on the blade said predetermined distance that the cutting edge is spaced from the axis or the roll of sheet material at the second end of the roll of sheet material being about 0.31 inch or 0.79 cm greater than the distance between the cutting edge and the axis of the roll of sheet material at the first end of the roll of sheet material.

10. A cut-off blade/supply roll spacing assembly for use on a portable dispenser for dispensing lengths of sheet material from roll of the sheet material having an axis, axially spaced first and second ends. and an inner surface defining a openings through both of said ends, sad dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end or said first hub; and an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

said cut-off blade/supply roll spacing assembly comprising:

a spacing arm having first and second ends;

a locating hub having an axis, said locating hub being mounted on said second end of said spacing arm and having a periphery around said axis adapted to be received in the opening through the second end of the roll of sheet material; and mounting means for affording mounting of said first end of said spacing arm on said cut-off blade so that with the roll of sheet material positioned around said first and locating hubs said spacing arm extends directly between said mounting means and said locating hub to space the cutting edge a predetermined distance from the axis of the roll of sheet material at the second end of the roll of sheet material a the sheet material is sequentially transversely cut along the cutting edge on the blade, said mounting means mounting said spacing arm for pivotal movement of said spacing arm around an axis at the firs end of the spacing arm between a use position at which the axis of the locating hub is coaxial with the axis of the first hub, and a loading position at which the spacing arm extends generally parallel to the length of the cut-off blade with the locating hub spiced from the axis of the first hub so that a roll of masking sheet material can be placed around the first hub.

11. A cut-off blade/supply roll spacing assembly for use on a dispenser adapted to dispense lengths of sheet material from rolls of the sheet material each having and axis, axially spaced first and second ends, and an inner surface defining an opening through both of said ends, the rolls having axial lengths between their first and second ends in a predetermined range of lengths, said dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub; and an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

said cut-off blade/supply roll spacing assembly comprising:

a spacing arm having first and second ends;

a locating hub having an axis, said locating hub being mounted on said second end of said spacing arm and having a periphery around said axis adapted to be received in the opening through the second end of the roll of sheet material; and means adapted for mounting said first end of said spacing arm on said cut-off blade so that with the roll of sheet material positioned around said first and locating hubs said spacing arm and locating hub space the cutting edges predetermined distance from the axis of the roll of sheet material at the second end of the roll of sheet material as the sheet material is sequentially transversely cut along the cutting edge on the blade, said means adapted for mounting said first end of said spacing arm on said cut-off blade affording positioning of said spacing arm at different locations longitudinally along said cut-off blade.

12. A cut-off blade/supply roll spacing assembly according to claim 11, wherein said means adapted for mounting affords pivotal movement of said spacing arm around an axis at the first end of the spacing arm between a use position at which the axis of the locating hub is coaxial with the axis of the first hub, and a loading position at which the spacing arm extends generally parallel to the length of the cut-off blade with the locating hub spaced from the axis of the first hub so that a roll of masking sheet material can be placed around the first hub.

13. A cut-off blade/supply roll spacing assembly according to claim 12 wherein said means for mounting comprises a slide block portion adapted to slide longitudinally along said blade, said first end of said spacing arm being mounted on said slide block portion to afford pivotal movement of said spacing arm around the axis at the first end of the spacing arm between said use and loading positions.

14. A cut-off blade/supply roll spacing assembly according to claim 13 wherein said slide block portion frictionally engages said blade, and said locating hub is fixed on said second end of said spacing arm with said periphery of said locating arm being adapted to received with a small clearance in the opening in the roll of sheet material.

15. A cut-off blade/supply roll spacing assembly according to claim 12 wherein said blade has a longitudinally extending slot, and said means for mounting comprises a member at said first end of said spacing arm extending through said slot to afford said sliding of the first end of said spacing arm longitudinally along said blade and said pivotal movement of said first end of the spacing arm between said use and loading positions.

16. A cut-off blade/supply roll spacing assembly according to claim 15 wherein said locating hub is rotatably mounted on said second end of said spacing arm and said periphery of said locating hub is adapted to frictionally engage the roll of sheet material.

17. A cut-off blade/supply roll spacing assembly for use on a dispenser for dispensing lengths of sheet material from a roll of the sheet material having an axis, axially spaced first and second ends, and an inner surface defining a openings through both of said ends, aid dispenser comprising:

a frame; a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub; and an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

said cut-off blade/supply roll spacing assembly comprising:

spacing arm having first and second ends;

locating hub having an axis, said locating hub being mounted on said second end of said spacing arm and having a periphery around said axis adapted to be received in the opening through the second end of the roll of sheet material; and means adapted for mounting said first end of said spacing arm on said cut-off blade so that with the roll of shed material positioned around said first and locating hubs said spacing am and locating hub space the cutting edge a predetermined distance from the axis of the roll of sheet material at the second end of the roll of sheet material as the sheet material is sequentially transversely cut along the cutting edge on the blade, said predetermined distance that the cutting edge is spaced from the axis of the roll of sheet material at the second end of the roll of sheet material being slightly greater than the distance between the cutting edge and the axis of the roll of sheet material at the first end of the roll of sheet material.

18. A cut-off blade/supply roll spacing assembly for use on a dispenser for dispensing lengths of sheet material from a roll of the sheet material having an axis, axially spaced first and second ends, and an inner surface defining a openings through both of said ends, said dispenser comprising:

a frame;

a first hub having an axis and first and second axially spaced ends, said first hub being mounted on said frame for rotation about said axis only at the first end of said first hub, and said first hub being adapted to receive a portion of the inner surface defining the opening through the first end of the roll of sheet material around a periphery of said first hub with the first end of the roll of sheet material adjacent the first end of said first hub; and an elongate cut-off blade having opposite distal and proximal longitudinally spaced ends and a cutting edge extending between said ends, said proximal end of said blade being attached to said frame with said cutting edge spaced from and extending generally parallel to the axis of the first hub so that with the roll of sheet material around the first hub a user of the dispenser can manually tension sheet material being pulled from the roll around said cutting edge to sequentially transversely sever the sheet material;

said cut-off blade/supply roll spacing assembly comprising:

a spacing arm having first and second ends;

a locating hub having an axis, said locating hub being mounted on said second end of said spacing arm and having a periphery around said axis adapted to be received in the opening through the second end of the roll of sheet material; and means adapted for mounting said first end of said spacing arm on said cut-off blade so that with the roll of sheet material positioned around said first and locating hubs said spacing arm and locating hub space the cutting edge a predetermined distance from the axis of the roll of sheet material at the second end of the roll of sheet material as the sheet material is sequentially transversely cut along the cutting edge on the blade, said predetermined distance that the cutting edge is spaced from the axis of the roll of sheet material at the second end or the roll of sheet material being about 0.31 inch or 0.79 cm greater than the distance between the cutting edge and the axis of the roll of sheet material at the first end of the roll of sheet material.

* * * * *

UNITED STATES PATENT AND TRADEMARK OFFICE

CERTIFICATE OF CORRECTION

PATENT NO. : 6,497,263 B1
DATED : December 24, 2002
INVENTOR(S) : Pitzen, James F.

It is certified that error appears in the above-identified patent and that said Letters Patent is hereby corrected as shown below:

Column 7,
Line 42, delete “fictionally” and insert -- frictionally --
Line 58, after “thereof” insert -- . --

Column 8,
Line 26, delete “sleet” and insert -- sheet --
Line 53, after “said” insert -- first --
Line 60, delete “nut-off” and insert -- cut-off --

Column 9,
Lien 9, delete “or” and insert -- of --
Line 26, delete “aids” and insert -- axis --
Line 33, delete “bock” and insert -- block --
Line 57, delete “tile” and insert -- the --

Column 11,
Line 8, delete “or” and insert -- of --
Line 16, after “from” insert -- a --
Line 18, delete “sad” and insert -- said --
Line 28, delete “or” and insert -- of --
Line 56, delete “a” and insert -- as --
Line 60, delete “firs” and insert -- first --
Line 65, delete “spiced” and insert -- spaced --

Column 12,
Line 40, delete “edges” and insert -- edge --.

Column 13,
Line 21, delete “aid’ and insert -- said --
Line 45, before “spacing” insert -- a --
Line 46, before “locating” insert -- a --
Line 53, delete “shed” and insert -- sheet --
Line 54, delete “am” and insert -- arm --

UNITED STATES PATENT AND TRADEMARK OFFICE

CERTIFICATE OF CORRECTION

PATENT NO. : 6,497,263 B1
DATED : December 24, 2002
INVENTOR(S) : Pitzen, James F.

It is certified that error appears in the above-identified patent and that said Letters Patent is hereby corrected as shown below:

Column 14,
Line 52, delete "or" and insert -- of --

Signed and Sealed this

Third Day of August, 2004

JON W. DUDAS
*Acting Director of the United States Patent and Trademark Office*